US006793424B2

(12) United States Patent
Yamada et al.

(10) Patent No.: US 6,793,424 B2
(45) Date of Patent: Sep. 21, 2004

(54) CUTTER DEVICE HAVING DETACHABLE BLADE AND PRINTER HAVING THE SAME

(75) Inventors: Kouichi Yamada, Tagata-gun (JP); Hiroyuki Koyama, Mishima (JP); Katsumune Hayashi, Suntou-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/443,944

(22) Filed: May 22, 2003

(65) Prior Publication Data

US 2004/0057771 A1 Mar. 25, 2004

(30) Foreign Application Priority Data

Sep. 20, 2002 (JP) ..... 2002-275881

(51) Int. Cl.[7] ..... B41J 11/70

(52) U.S. Cl. ..... 400/621; 101/93.07; 83/352; 83/471

(58) Field of Search ..... 400/621, 621.1; 83/352, 353, 471, 471.1, 471.2; 101/93.07

(56) References Cited

U.S. PATENT DOCUMENTS 4,907,014 A * 3/1990 Tzeng et al. ..... 346/24
5,001,952 A 3/1991 Myogadani
5,833,380 A * 11/1998 Hosomi et al. ..... 400/621
5,887,999 A * 3/1999 Smith et al. ..... 400/621
6,155,731 A * 12/2000 Bertalan et al. ..... 400/621
6,347,896 B1 * 2/2002 Robinson ..... 400/621
6,361,231 B1 * 3/2002 Sato et al. ..... 400/621
6,443,645 B1 * 9/2002 Takei et al. ..... 400/621
6,447,187 B1 * 9/2002 Robinson ..... 400/621

FOREIGN PATENT DOCUMENTS

JP 11-208041 A 8/1999

* cited by examiner

*Primary Examiner*—Andrew H. Hirshfeld
*Assistant Examiner*—Dave A. Ghatt
(74) *Attorney, Agent, or Firm*—Frishauf, Holtz, Goodman & Chick, P.C.

(57) ABSTRACT

A cutter device comprising a fixed blade and a movable blade is disclosed, the movable blade being opposed to the fixed blade and adapted to be displaced in such a manner that an engaging position thereof with the fixed blade shifts continuously. The cutter device is constructed so that the movable blade can be attached to and detached from a body of the device. Thus, attachment and detachment of the movable blade can be effected without requiring any troublesome work.

8 Claims, 8 Drawing Sheets

Prior Art

CUTTER DEVICE HAVING DETACHABLE BLADE AND PRINTER HAVING THE SAME

CROSS REFERENCE TO RELATED APPLICATION

The present application is based on Japanese Priority Document JP2002-275881 filed on Sep. 20, 2002, the content of which is incorporated herein by reference.

BACKGROUND OF THE INVENTION

1. Field of the Invention

The present invention relates to a cutter device provided in a printer for printing images, such as, e.g., characters, figures, onto a continuous paper. Particularly, the invention is concerned with a cutter device for cutting continuous paper into an appropriate length.

2. Discussion of the Background

Heretofore, various cutter devices have been known for cutting continuous paper into an appropriate length. Printers and facsimile devices using such cutter devices are in many cases provided with a cutter section on a downstream side of a printing section in a paper conveying direction.

A conventional cutter device is shown in FIG. 9. A rotary type cutter device 100 is provided with a fixed blade 101 which is supported in a fixed state and a movable blade 103 which is rotatable about a support shaft 102. Fixed blade 101 and movable blade 103 each have a plate-like shape and are arranged in a non-parallel state while allowing respective edges 101*a* and 103*a* to mesh partially with each other.

In the cutter device 100, a motor (not shown) and support shaft 102 are connected with each other through a gear train (not shown) or the like and a driving force of the motor is transmitted to the support shaft 102 through a gear train or the like, whereby movable blade 101 is rotated. Such drive components including the motor and the gear train are mounted to a frame 104 which supports fixed blade 101 and movable blade 103. Movable blade 103 is rotated by the motor through the gear train, causing the meshing position of edges 101*a* and 103*a* to move in one direction, thereby cutting continuous paper which has been fed to between fixed blade 101 and movable blade 103, like scissors.

However, in cutter device 100 of such a construction, when movable blade 103 having expired its service life is to be replaced with a fresh one, it is required to disassemble the frame 104 and drive components, or else it will be impossible to detach the movable blade 103. Thus, blade replacing work is troublesome.

SUMMARY OF THE INVENTION

Accordingly, an object of the present invention is to attach or detach a movable blade without requiring any complicated work.

The object of the present invention is achieved by a novel cutter according to the present invention.

The novel cutter device of the present invention is provided with a fixed blade which is supported at a predetermined position and a movable blade opposed to the fixed blade, the movable blade being displaced so that its position of engagement with the fixed blade shifts continuously, the movable blade capable of being attached and detached.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE INVENTION

An embodiment of the present invention will be described with reference to the accompanying drawings.

This embodiment shows an application example to a printer which uses a rolled recording paper.

Figure 1:
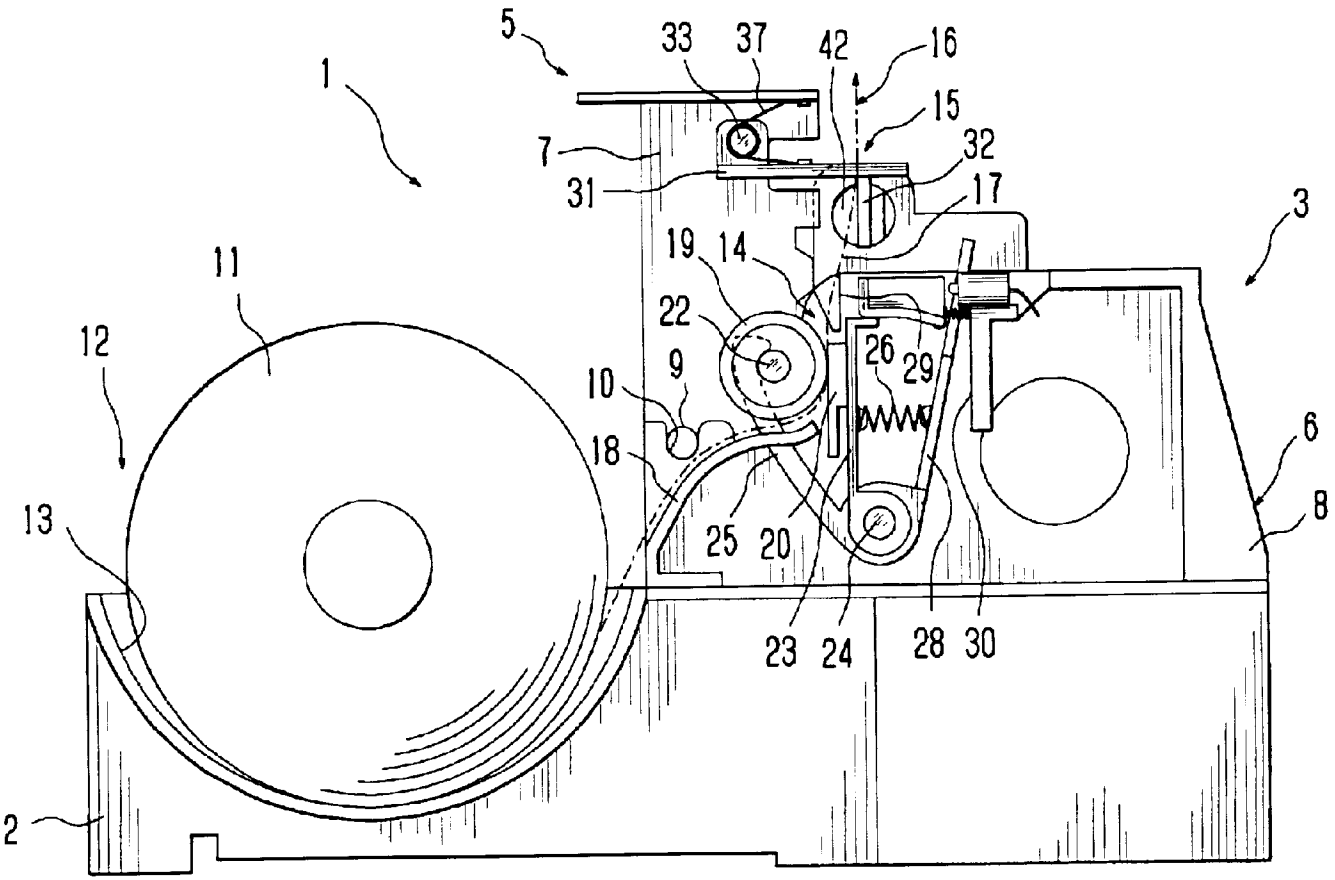
FIG. 1 is a side view in vertical section showing schematically a printer provided with a cutter device according to the present invention.

As shown in FIG. 1, a printer 1 is provided with a body frame 2 and a drive unit 3 which is attached on an upper side of body frame 2. Drive unit 3 can be detached with respect to body frame 2 and is normally fixed to body frame 2 with screws 4 (see FIG. 7).

Figure 2:
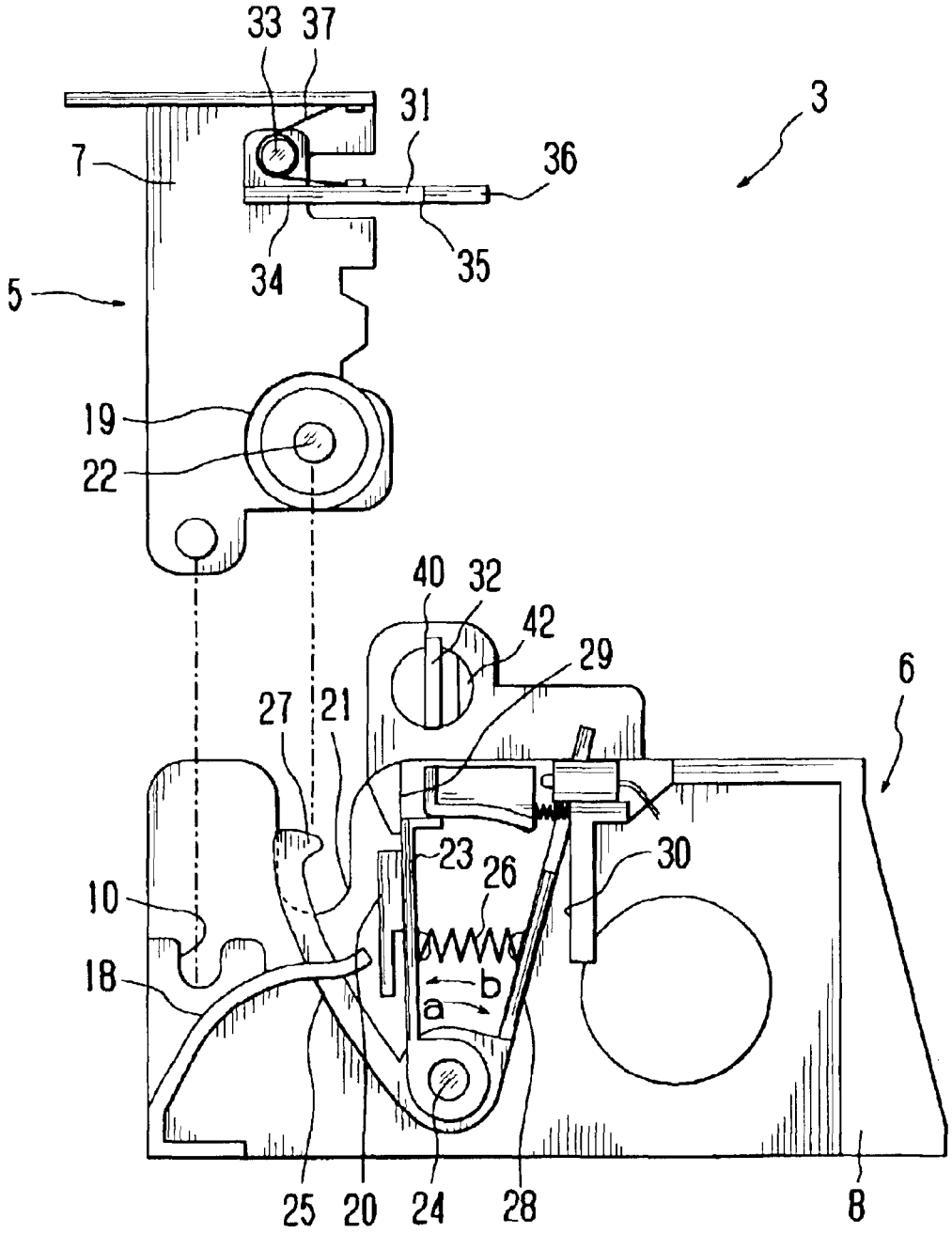
FIG. 2 is a side view in vertical section showing a disassembled state of a drive unit provided in the cutter device.

Drive unit 3 includes an upper unit 5 and a lower unit 6 which are combined together in a separable manner. Upper unit 5 and lower unit 6 have an upper unit frame 7 and a lower unit frame 8, respectively, which are generally in a rectangular shape and which are each open on one side thereof. Both units 5 and 6 are combined together in a state in which the respective openings are opposed to each other as shown in FIG. 2.

Upper unit 5 and lower unit 6 are positioned relative to each other by fitting a connecting shaft 9 provided in upper unit frame 7 and a positioning slot 10 formed in lower unit frame 8 with each other. Slot 10 is formed on its upper side in FIG. 1.

Upper unit frame 7 is fitted in and combined with lower unit frame 8. In this way a transverse position of upper unit 5 relative to lower unit 6 is guided.

A paper receptacle portion 12 is formed to body frame 2 to receive and hold a rolled continuous paper 11. In this embodiment, paper receptacle portion 12 has an arcuate bottom 13, and a thermal rolled paper having a thermosensitive color developing property is set onto the bottom 13.

A paper conveying path 17 indicated by a dot and dashed line in FIG. 1 is in communication with paper receptacle portion 12. Paper conveying path 17 functions to guide continuous paper 11 drawn out from paper receptacle portion 12 up to a discharge section 16 via a printing section 14 and a cutter device 15 successively. In this embodiment it is assumed hereinafter that paper receptacle portion 12 side of paper conveying path 17 is an upstream side and discharge section 16 side thereof is a downstream side. A guide member 18 is provided along paper convey path 17 to guide continuous paper 11 from the upstream side to the downstream side.

A description will now be given of printing section 14. Printing section 14 is provided with a roll-shaped platen 19 and a print head 20 which comes into abutment against platen 19 through paper conveying path 17.

Platen 19 is held by upper unit 7 so as to be rotatable about an axis thereof. Platen 19 is also held by lower unit frame 8 rotatably in a coupled state of both upper and lower units 5, 6. A shaft holding portion 21 is formed at lower unit frame 8 to rotatably hold a support shaft 22 of platen 19.

With upper unit 5 and lower unit 6 connected together, a gear train (not shown) is connected to a support shaft 22. This gear train is mounted to lower unit frame 8 and is connected to a motor (not shown) attached in lower unit 6. A driving force is transmitted from the motor to support shaft 22 through the gear train. Platen 19 rotates with the driving force of the motor to convey continuous paper 11 from paper receptacle portion 12 along paper conveying path 17.

Print head 20 is held by a flat plate-shaped head holding member 23 which is provided in lower unit frame 8. Head holding member 23 is pivotable about a pivot shaft 24 provided in lower unit frame 8. By rotation with pivot shaft 24 as a center, print head 20 is swinged toward and away from platen 19. Head holding member 23 is urged in a direction to abut platen 19 by a coiled spring 26 which is stretched between head holding member 23 and a hook member 25 to be described later.

Since in this embodiment there is used a thermosensitive color developing paper as continuous paper 11, a thermal head having plural heat generating resistors (not shown) is used as print head 20. Print head 20 is supported by head holding member 23 in a state in which the heat generating resistors are opposed to platen 19.

Print head 20 is not limited to the thermal head, but a suitable print head may be selected according to the type of continuous paper 11 used. For example, in the case of using a pressure-sensitive color developing paper as continuous paper 11, an impact dot head which carries out printing by projecting wires selectively may be used. Further, for example in the case of using plain paper as continuous paper 11, an ink jet head which ejects ink in dot form may be used.

Hook member 25 is provided in lower unit 8 and has a hook 27, hook 27 being engaged disengageably with support shaft 22 which is held by shaft holding portion 21. hook member 25 is pivotable about pivot shaft 24 and has a generally V shape with pivot shaft 24 as a turning point. Hook 27 is formed at an end of hook member 25 opposite to pivot shaft 24.

A flat plate-like portion 28 of hook member 25 extending to an opposite side from pivot shaft 24 is urged in the direction of arrow "a" in FIG. 2 by coiled spring 26 stretched between the portion 28 and head holding member 23. As a result, with upper and lower units 5, 6 coupled together, hook member 25 is urged in a direction (arrow "a" direction in FIG. 2) in which hook 27 is brought into engagement with support shaft 22 of platen 19.

The tip of hook 27 is formed at a predetermined angle relative to a coupling/uncoupling direction (vertical direction in FIG. 1) of upper unit 5 and lower unit 6. With hook 27 thus formed, as upper and lower units 5, 6 are coupled with or uncoupled from each other, hook member 25 pivots against the urging force of coiled spring 26 while escaping its interference with support shaft 22. In this way, with coupling or uncoupling of upper unit 5 and lower unit 6, it is possible to lock or unlock the coupling of the two without requiring any special operation. The engagement between hook 27 and support shaft 22 can be released also manually by an operator.

With upper unit 5 and lower unit 6 uncoupled from each other, hook member 25 and head holding member 23 are urged by coiled spring 26 and are positioned in abutment against positioning faces 29 and 30 respectively which are formed in lower unit frame 8.

Figure 3:
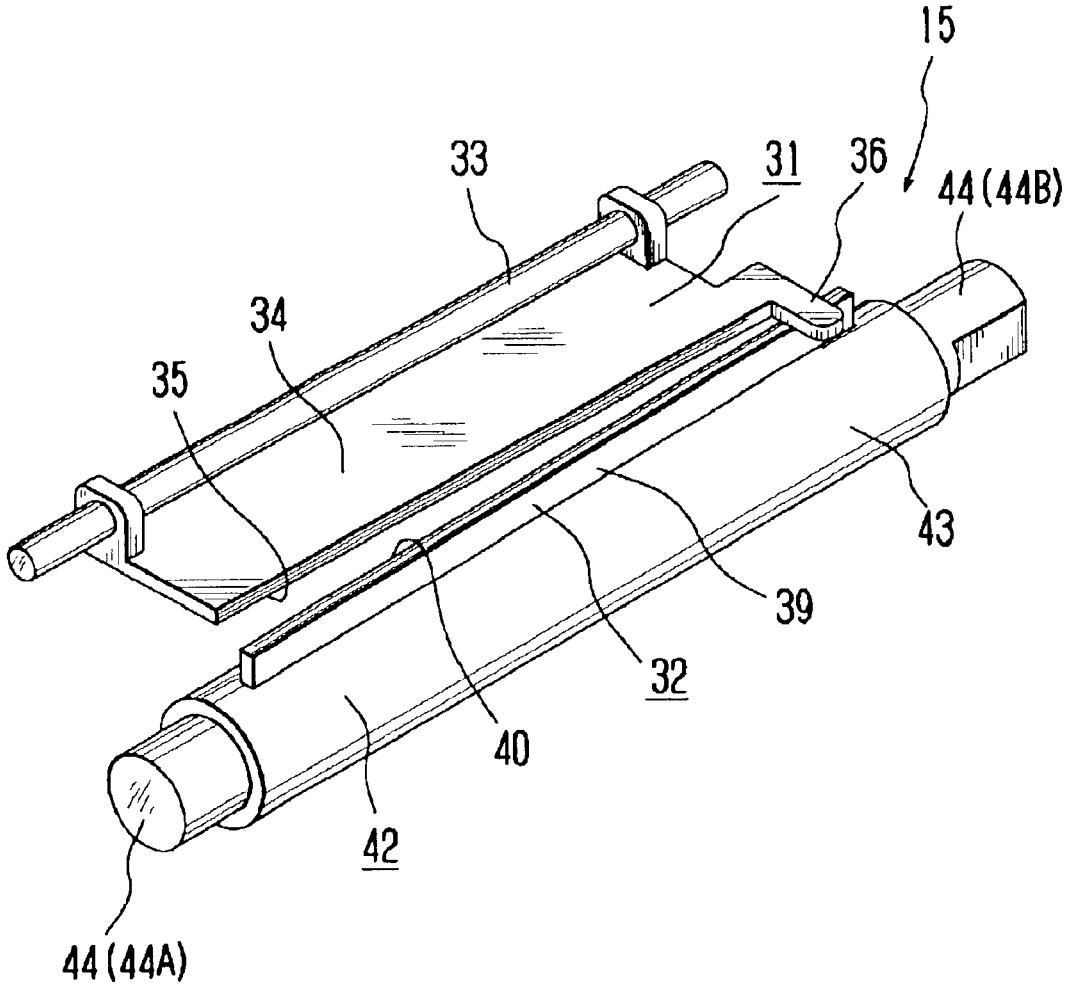
FIG. 3 is a perspective view of the cutter device.

Cutter device 15 will now be described. As shown in FIG. 3, cutter device 15 is provided with a fixed blade 31 and a movable blade 32, which are each in a generally flat plate shape.

Fixed blade 31 is mounted to upper unit frame 7 so as to be pivotable about a pivot shaft 33. Fixed blade 31 has a base portion 34 as a main component and an edge 35 which is extending from base portion 34 positioned on the side opposite to pivot shaft 33. Fixed blade 31 is further provided with a guide portion 36 projecting from one end side of edge 35 in a direction away from pivot shaft 33. Edge 35 of fixed blade 31 has a length which covers the overall width of the continuous paper 11.

With fixed blade 31 and movable blade 32 engaged with each other, fixed blade 31 is urged in a direction in which edge 35 faces movable blade 32 by a torsion spring 37 stretched between fixed blade 31 and upper unit frame 7.

Movable blade 32 has a base portion 39 (see FIG. 4) as a main component and an edge 40 which is extending from base portion 39. Two holes 41 are formed apart from each other in base portion 39 (see FIG. 4). Edge 40 of movable blade 32 has a length which covers the overall width of the continuous paper 11.

Figure 4:
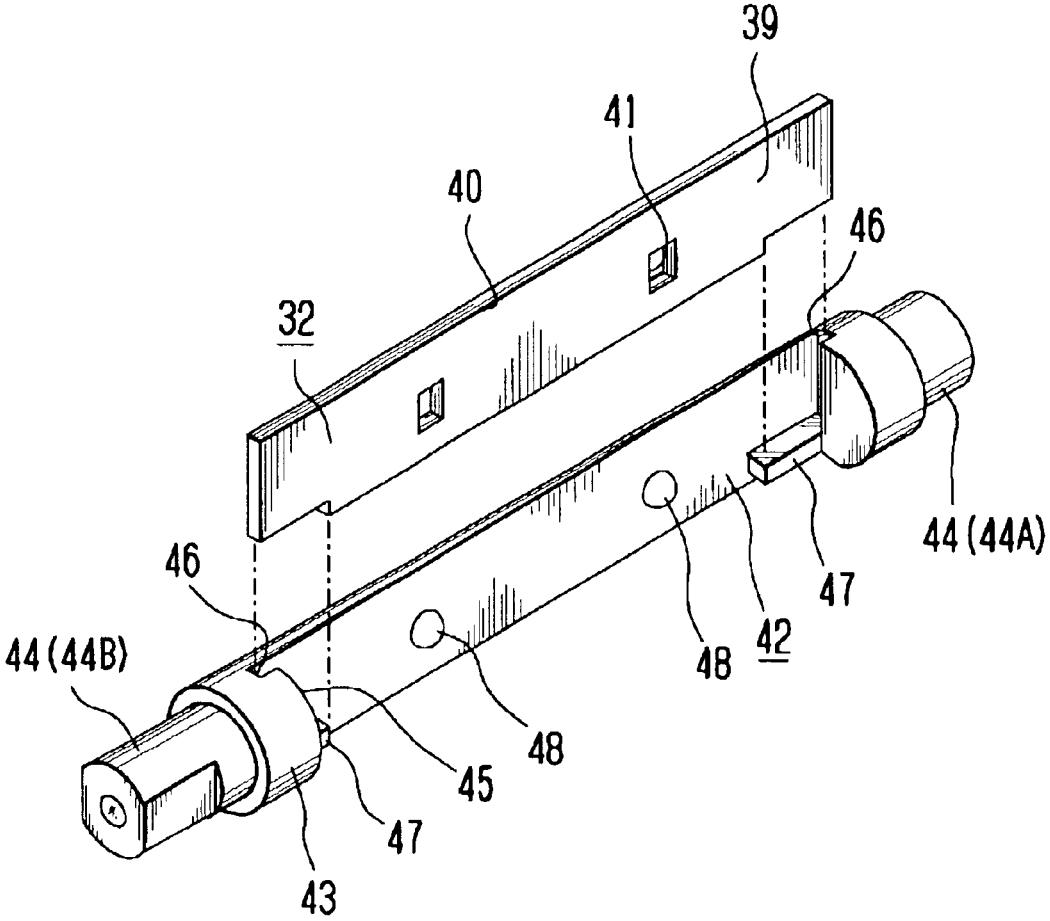
FIG. 4 is an exploded perspective view showing a movable blade and a movable blade holding member both provided in the cutter device.

As shown in FIG. 4, movable blade 32 is held by a movable blade holding portion 42. Movable blade holding portion 42 is provided with a movable blade holding member 43 and pivot shafts 44 (44A, 44B), pivot shafts 44 being formed at both longitudinal ends of movable blade holding member 43 and supported pivotably by lower unit frame 8. Movable blade holding portion 42 is disposed in parallel with the axis of platen 19 and is supported by lower unit frame 8 so as to be pivotable about pivot shafts 44. Movable blade holding portion 42 has a semi-cylindrical cutout portion 45 which permits attaching and detaching of movable blade 32. Cutout portion 45 has a pair of slots 46 in both longitudinal end positions, slots 46 each having a width equal to the thickness of movable blade 32. Slots 46 are respectively provided with positioning portions 47 for positioning movable blade 32 which is fitted in cutout portion 45.

Figure 5:
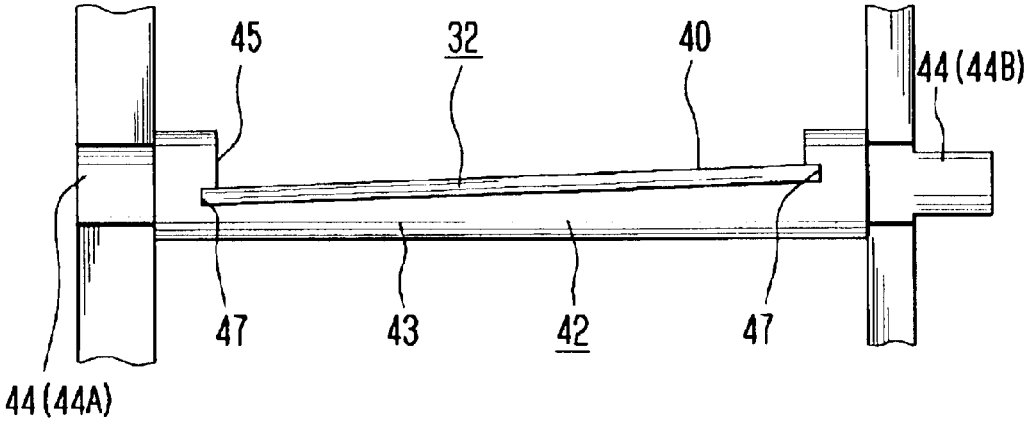
FIG. 5 is a plan view of the movable blade holding member as seen from a cutting edge side of the movable blade in the cutter device, the movable blade holding member being in a state of holding the movable blade.

As shown in FIG. 5, cutout portion 45 is formed so as to be inclined in its longitudinal direction relative to the longitudinal direction of movable blade holding member 43. The location of one of slots 46 is offset relative to that of the other slot 46 in the longitudinal direction of movable blade holding member 43, whereby movable blade 32 is held in an inclined state from one end thereof supported by the other slot 46 toward the other end supported by the one of slots 46. In this embodiment cutout portion 45 is formed so as to be slightly inclined in such a manner that movable blade 32 when fitted in movable blade holding member 43 is slightly inclined from an angle parallel to the axial direction of movable blade holding member 43.

In cutout portion 45 there are formed semi-circular protuberances 48 in positions corresponding to holes 41 formed in base portion 39 of movable blade 32. By engagement with holes 41 formed in base portion 39 protuberances 48 function to fix movable blade 32 to movable blade holding member 43. Here there is realized a structure for engaging movable blade 32 and movable blade holding member 43 with each other.

Movable blade holding member 43 used in this embodiment is formed of a resin material having elasticity to such an extent as permits attaching and detaching of movable blade 32 with respect to movable blade holding member 43.

Figure 6:
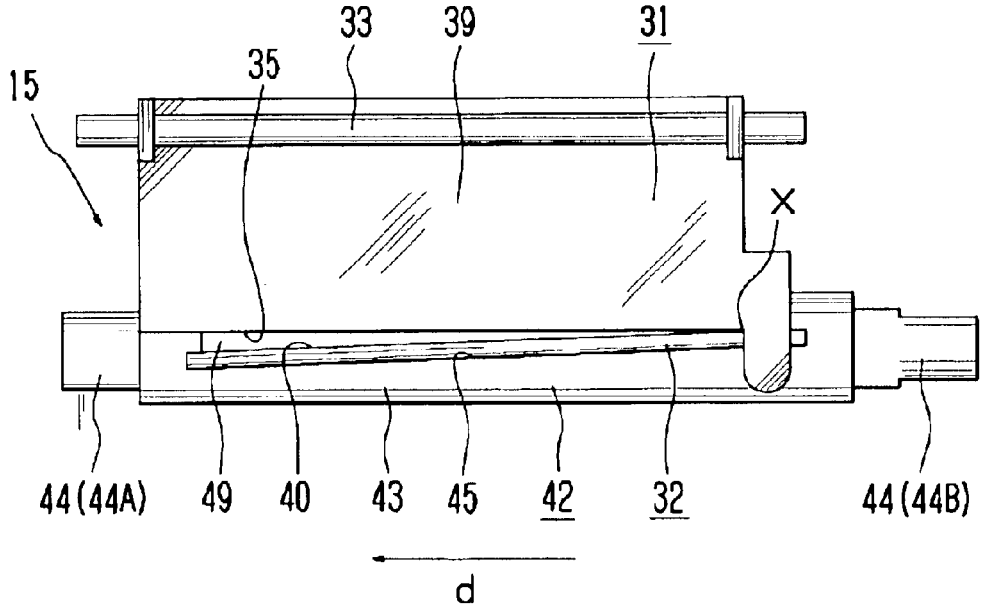
FIG. 6 is a plan view of the cutter device as seen from the cutting edge side of the movable blade.

With upper unit 5 and lower unit 6 coupled together, fixed blade 31 is urged so as to be pushed against movable blade 32 through guide portion 36 by the biasing force of torsion spring 37. Guide portion 36 is in contact with movable blade 32 at a position outside the width of continuous paper 11, whereby between edge 35 of fixed blade 31 and edge 40 of movable blade 32 there is formed a V-shaped path 49 for an object to be cut, as shown in FIG. 6. Edge 35 of fixed blade 31 and edge 40 of movable blade 32 are partially in contact with each other for intermeshing. Here there is realized a structure for supporting the movable blade 32. The position where edge 35 of fixed blade 31 and edge 40 of movable blade 32 engage each other will hereinafter be referred to as the position X. Path 49 for an object to be cut constitutes a part of paper conveying path 17 and continuous paper 11 is introduced into path 49. At this time, one surface on paper conveying path 17 side of base portion 39 in movable blade 32 also functions to positionally guide continuous paper 11.

Figure 7:
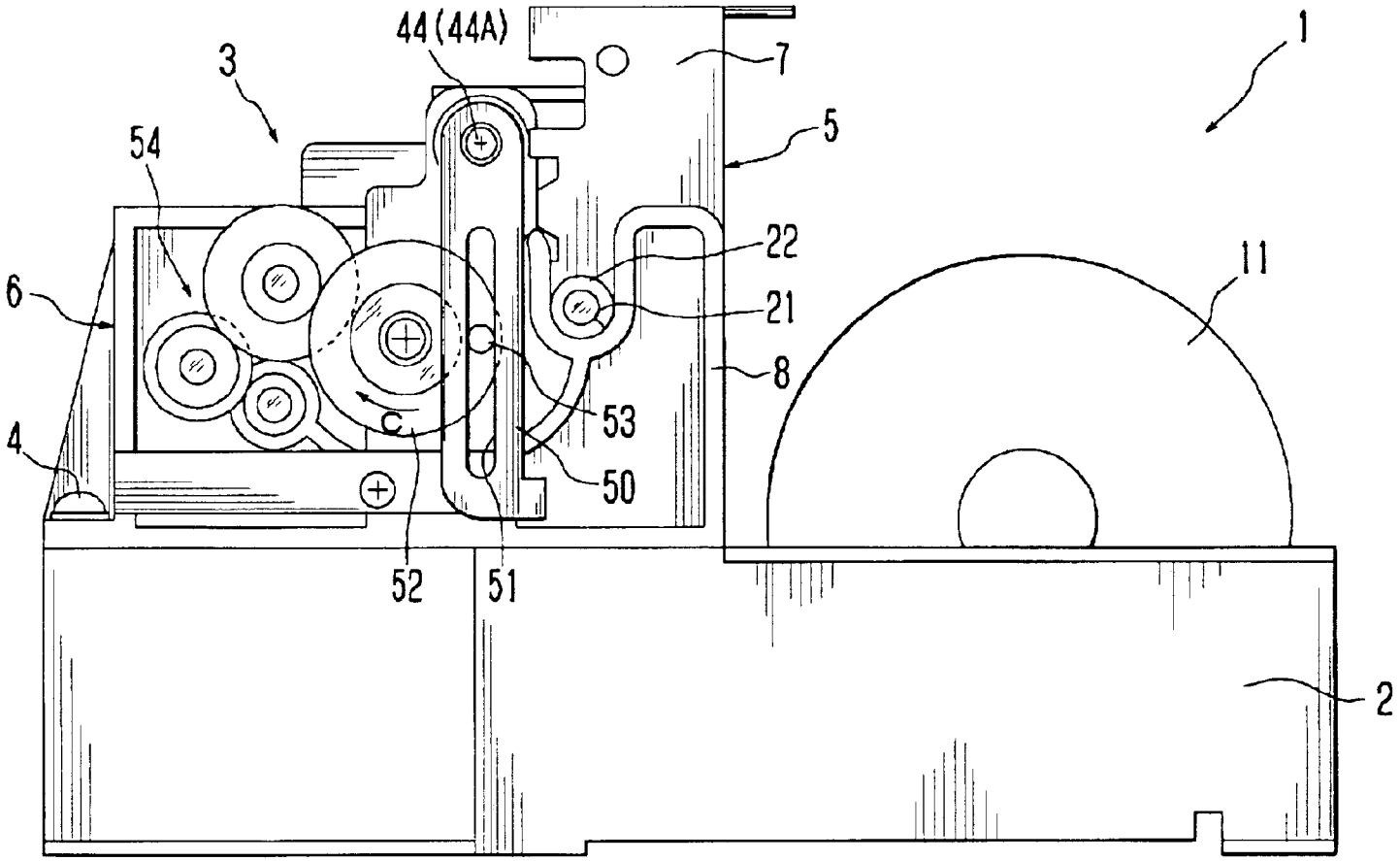
FIG. 7 is a side view showing a structure for effecting a cutting operation in the cutter device.

The following description is now provided about a structure for effecting the cutting operation of cutter device 15, which operation is illustrated in FIG. 7. A cutter arm 50 is mounted on the pivot shaft 44B in movable blade holding portion 42 so as to be pivotable about pivot shaft 44B. An elongated hole 51 which is long in a direction away from pivot shaft 44 is formed in cutter arm 50. A drive crank 52 is pivotable about pivot shaft 44 mounted on lower unit frame 8. A cutter motor (not shown), which is provided in lower unit frame 8, is connected to drive crank 52 through a gear train 54. The cutter motor causes drive crank 52 to rotate in a direction of arrow "c" in FIG. 7. An eccentric pin 53 is provided on drive crank 52 and is engaged in the elongated hole 51 so as to be slidable with respect to the elongated hole 51 as drive crank 52 rotates.

Printing section 14 and cutter device 15 can each function in a coupled state of both upper unit 5 and lower unit 6.

In addition, printer 1 is provided with a control section for controlling the operation of its components, though not shown.

In such a construction, when a printing operation is to be performed, the motor with platen 19 connected thereto and print head 20 are actuated by the control section, thereby printing images onto continuous paper 11 while conveying continuous paper 11 along paper conveying path 17.

When the printing is over, a cutter motor (not shown) is turned ON by the control section and a driving force thereof is transmitted to drive crank 52 through gear train 54 to rotate drive crank 52. At this time, since eccentric pin 53 and elongated hole 51 are in engagement with each other, eccentric pin 53 causes cutter arm 50 to pivot while sliding through elongated hole 51 as drive crank 52 rotates. With the pivotal motion of cutter arm 50, movable blade holding portion 42 rotates about pivot shafts 44.

With rotation of movable blade holding portion 42, the engaging position X between edge 35 of fixed blade 31 and edge 40 of movable blade 32 shifts in the direction indicated with arrow "d" in FIG. 6 along edge 35 of fixed blade 31. Here there is realized a structure for displacing movable blade 32. As a result, the path 49 for an object to be cut is narrowed gradually, and edge 35 of fixed blade 31 and edge 40 of movable blade 32 engage each other like scissors.

As the movable blade holding portion 42 rotates, an urging force for turning fixed edge 35 upward acts on edge 35 which is positioned above movable blade holding portion 42. However, since fixed edge 35 is urged in a direction opposite to the pivoting direction thereof with a restoring force of the torsion spring 37, an interpushing force is exerted between edge 35 of fixed blade 31 and edge 40 of movable blade 32. Consequently, edge 35 of fixed blade 31 and edge 40 of movable blade 32 are engaged with each other like scissors, whereby continuous paper 11 which has been conducted into path 49 can be cut.

Although in this embodiment movable blade holding portion 42 which holds movable blade 32 is made rotatable about pivot shafts 44 and the continuous paper 11 is cut by rotating pivot shafts 44, this constitutes no limitation. For example, there may be adopted a construction wherein movable blade 32 which is held so as to cause tilting of its edge 40 relative to edge 35 of fixed blade 31 is allowed to slide horizontally in FIG. 1 to let path 49 become narrower gradually, thereby engaging edge 35 of fixed blade 31 and edge 40 of movable blade 32 with each other like scissors to cut continuous paper 11 which has been conducted into path 49.

Although in this embodiment the fixed blade 31 is disposed in parallel with axis of platen 19 and movable blade 32 is disposed inclinedly relative to the platen axis, this constitutes no limitation. For example, in the case of a cutter device having a structure wherein the continuous paper 11 is cut by sliding movable blade 32 in the parallel direction, fixed blade 31 may be inclined and movable blade 32 in parallel with respect to the axis of platen 19.

However, according to cutter device 15 of the rotary type wherein movable blade 32 is rotated as in this embodiment, continuous paper 11 can be cut positively with a simple structure without increasing the size of cutter device 15.

In cutter device 15 of this embodiment, when movable blade 32 reaches expiration of its service life, movable blade 32 can be replaced in accordance with the following procedure.

Figure 8:
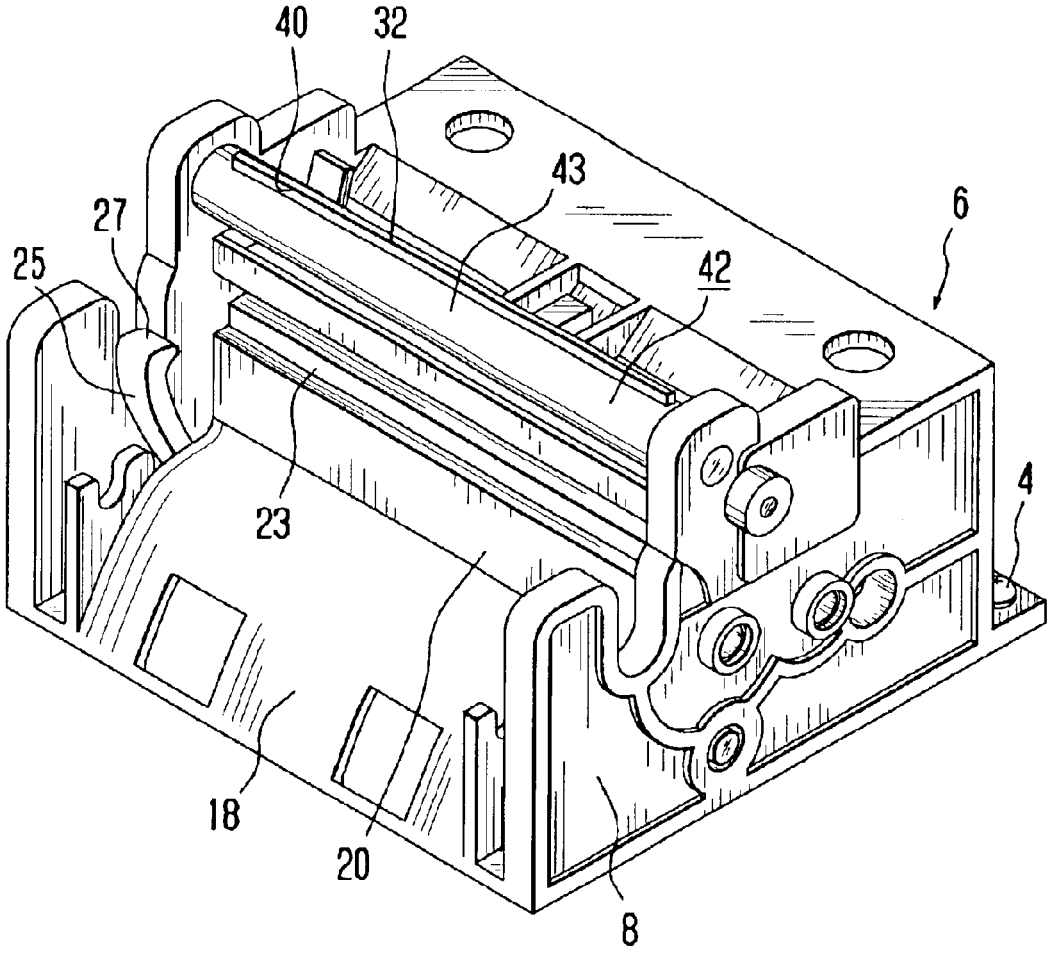
FIG. 8 is a perspective view of the cutter device with an upper unit detached.
Figure 9:
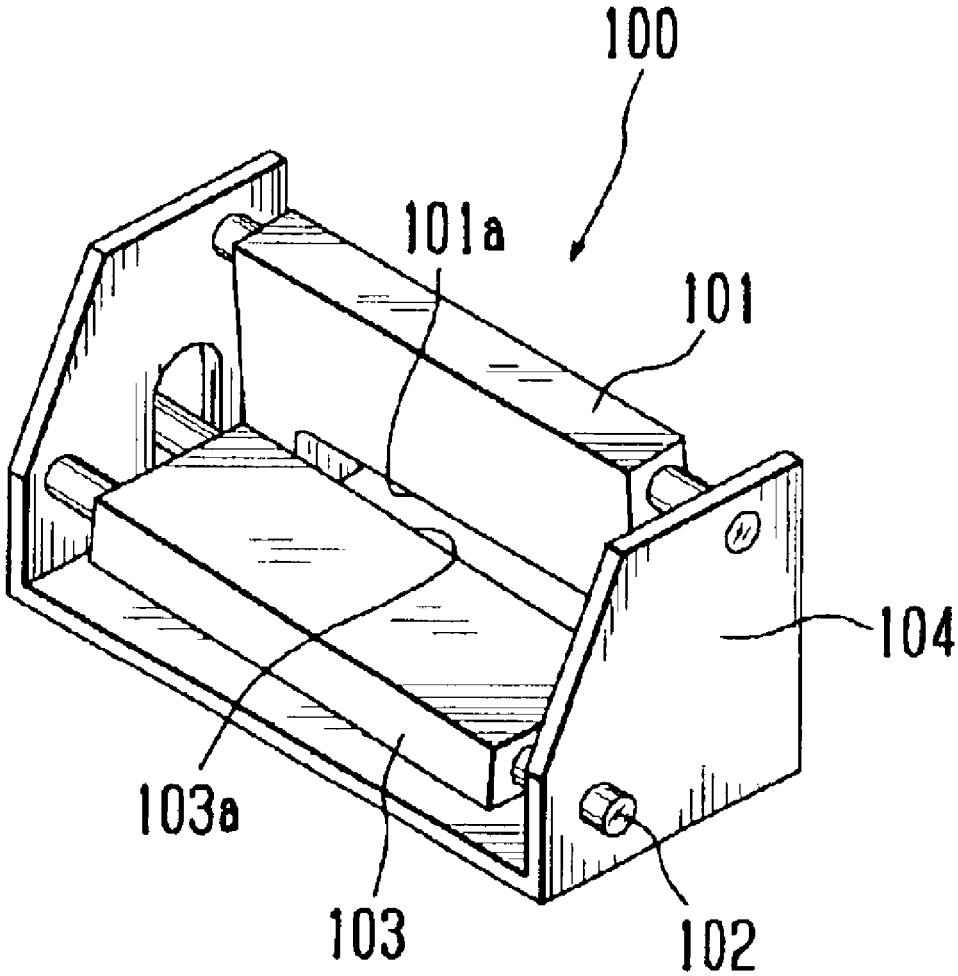
FIG. 9 is a perspective view of a conventional cutter device.

In replacing movable blade 32, first upper unit 5 is detached. As a result, movable blade 32 assumes an exposed state as in FIG. 8. Now, the operator can detach movable blade 32 by only a simple operation of pulling out movable blade 32 from cutout portion 45 of movable blade holding member 43. Here there is realized a structure which permits attaching and detaching of movable blade 32.

In this connection, since movable blade holding member 43 is formed of an elastic material, movable blade holding member 43 deflects in a direction to disengage holes 41 and protuberances 48 as movable blade 32 is pulled out from cutout portion 45. Consequently, movable blade 32 can be detached easily without the need of any troublesome work.

After movable blade 32 is removed, a new one can be attached by performing the above operation in reverse order.

In this case, as movable blade 32 is inserted into cutout portion 45, movable blade holding member 43 deflects in a direction to permit engagement between holes 41 and protuberances 48, whereby movable blade 32 can be attached easily without requiring any troublesome work.

With continuous paper 11 conducted to above the movable blade 32, upper unit 5 is again combined with lower unit 6, and connecting shaft 9 and positioning slot 10 are fitted together to position upper and lower units 5, 6. In this state support shaft 22 is locked with hook member 25. Now, printing is ready.

Obviously, numerous modifications and variations of the present invention are possible in light of the above teachings. It is therefore to be understood that within the scope of the appended claims, the invention may be practiced otherwise as specifically described herein.

What is claimed is:

1. A cutter device having a body for cutting a rolled recording medium, comprising:

a first unit located at a predetermined position on the body;

a second unit removably combined with the first unit;

a fixed blade supported at a predetermined position on the second unit;

a holding member movably supported by the first unit;

a movable blade detachably supported by the holding member so that the movable blade partially engages the fixed blade at an engagement position when the second unit is combined with the first unit, the movable blade being exposed when the second unit is removed from the first unit; and a motor for displacing the movable blade via the holding member to continuously shift the engagement position between the fixed blade and the movable blade;

wherein the movable blade is attachable to and detachable from the holding member when the second unit is removed from the first unit;

wherein the holding member comprises:

an elongated body;

pivot shafts at each end of the elongated body for rotatably supporting the holding member on the first unit;

a cutout portion formed in the elongated body and extending in an elongated direction of the elongated body; and a pair of slots formed in the elongated body and communicating with the cutout portion in the elongated direction, wherein a first one of the slots is offset relative to a second one of the slots in the elongated direction of the elongated body of the holding member.

2. The device according to claim 1, wherein the movable blade includes an elongated flat body having elongated ends, and wherein a first one of the elongated ends is supported by the first one of the slots of the holding member and a second one of the elongated ends is supported by the second one of the slots of the holding member, whereby the movable blade is slightly inclined from an angle parallel to the elongated direction of the elongated body of the holding member.

3. The device according to claim 2, wherein the movable blade includes two holes formed in the elongated flat body apart from each other in an elongated direction of the elongated flat body, wherein the holding member includes two projections, exposed to the cutout portion, opposed to the holes, and wherein the two projections of the holding member are respectively fitted into the two holes of the movable blade when the movable blade is supported by the holding member.

4. The device according to claim 2, wherein the fixed blade includes an elongated flat body and a guide portion projecting from one end of the elongated flat body of the fixed blade, and wherein the guide portion contacts the first one of the elongated ends of the elongated flat body of the movable blade in a standby state in which the rolled recording medium is fed to between the fixed blade and the movable blade.

5. A printer, comprising:

a receptacle section receiving a rolled recording medium;

a printing section for printing an image on the recording medium from the receptacle section;

a cutter section for cutting the recording medium from the printing section at a prescribed length, the cutter section comprising:

a body, a first unit located at a predetermined position on the body, a second unit removably combined with the first unit, a fixed blade supported at a predetermined position on the second unit, a holding member movably supported by the first unit, a movable blade detachably supported by the holding member so that the movable blade partially engages the fixed blade at an engagement portion when the second unit is combined with the first unit, the movable blade being exposed when the second unit is removed from the first unit; and a motor for displacing the movable blade of the cutter section via the holding member to continuously shift the engagement position between the fixed blade and the movable blade to cut the recording medium, wherein the movable blade is attachable to and detachable from the holding member when the second unit is removed from the first unit; and wherein the holding member comprises:

an elongated body;

pivot shafts at each end of the elongated body for rotatably supporting the holding member on the first unit;

a cutout portion formed in the elongated body and extending in an elongated direction of the elongated body; and a pair of slots formed in the elongated body and communicating with the cutout portion in the elongated direction, wherein a first one of the slots is offset relative to a second one of the slots in the elongated direction of the elongated body of the holding member.

6. A cutter device having a fixed blade and a movable blade opposed to the fixed blade, said cutter device comprising:

a first structure which rotatably supports the movable blade via a movable blade holding member which is provided rotatably so that the movable blade partially engages the fixed blade at an engagement position;

a second structure which rotates the movable blade so that the engagement position lies on a rotational path formed by rotation of the movable blade and shifts continuously;

a third structure which permits attaching and detaching of the movable blade holding member to and from the first structure; and a fourth structure for engaging the movable blade and the movable blade holding member with each other at a position between the movable blade and the movable blade holding member.

7. The cutter device according to claim 6, wherein the movable blade and the fixed blade each have a flat plate shape, wherein the movable blade holding member holds the movable blade at an incline relative to an axis of the movable blade holding member, and wherein the first structure supports the movable blade so that the fixed blade and a rotational axis of the movable blade holding member are parallel to each other.

8. A printer comprising:

a paper conveying section for conveying a continuous recording paper;

a printing section for printing an image onto the paper which is conveyed by the paper conveying section; and a cutter device;

wherein the cutter device comprises a fixed blade supported at a predetermined position, a movable blade opposed to the fixed blade with the paper therebetween;

a first structure which rotatably supports the movable blade via a movable blade holding member which is provided rotatably so that the movable blade partially engages the fixed blade at an engagement position;

a second structure which rotates the movable blade so that the engagement position lies on a rotational path formed by rotation of the movable blade and shifts continuously;

a third structure which permits attaching and detaching of the movable blade to and from the first structure; and a fourth structure for engaging the movable blade and the movable blade holding member with each other at a position between the movable blade and the movable blade holding member.

* * * * *